US008997273B2

(12) United States Patent
Murphy et al.

(10) Patent No.: US 8,997,273 B2
(45) Date of Patent: Apr. 7, 2015

(54) SEATING UNIT CONVERTIBLE TO BED

(71) Applicant: Ultra-Mek, Inc., Denton, NC (US)

(72) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 13/900,311

(22) Filed: May 22, 2013

(65) Prior Publication Data

US 2014/0345044 A1 Nov. 27, 2014

(51) Int. Cl.
*A47C 17/23* (2006.01)
*A47C 17/22* (2006.01)

(52) U.S. Cl.
CPC ..... *A47C 17/225* (2013.01)

(58) Field of Classification Search
USPC ..... 5/12.1, 13, 14, 28–32, 35, 36, 42, 56, 5/312, 313.1, 314.1
See application file for complete search history.

(56) References Cited

U.S. PATENT DOCUMENTS

| | | | |
|---|---|---|---|
| 213,512 | A | 3/1879 | Landis et al. |
| 577,138 | A | 2/1897 | Hubbard et al. |
| 640,647 | A | 1/1900 | Gannett et al. |
| 1,018,593 | A | 2/1912 | Swanson et al. |
| 1,043,071 | A | 11/1912 | Coopersmith |
| 1,218,608 | A | 3/1917 | Arnold |
| 1,509,863 | A | 9/1924 | Erickson |
| 1,690,797 | A | 11/1928 | Schwab |
| 1,945,186 | A | 1/1934 | Frank et al. |
| D151,983 | S | 12/1948 | Guertin |
| D151,984 | S | 12/1948 | Guertin |
| D160,390 | S | 10/1950 | Hubbert |
| 2,577,741 | A | 12/1951 | Creveling et al. |
| 2,579,577 | A | 12/1951 | Hill et al. |
| 2,582,703 | A | 1/1952 | Kirshbaum |
| 2,625,204 | A | 1/1953 | Beichman |

(Continued)

FOREIGN PATENT DOCUMENTS

| | | |
|---|---|---|
| EP | 1913846 | 4/2008 |
| GB | 626821 | 7/1949 |

OTHER PUBLICATIONS

International Search Report and Written Opinion for corresponding PCT Application No. PCT/US2014/038908, date of mailing Oct. 16, 2014.

*Primary Examiner* — Michael Trettel
(74) *Attorney, Agent, or Firm* — Myers Bigel Sibley & Sajovec, P.A.

(57) ABSTRACT

A seating unit that includes a foldable bed includes: a base with an internal cavity; a foldable bed that includes a plurality of sections, wherein in a folded position, the bed sections are folded relative to each other and stored within the base cavity, and in an unfolded position, the bed sections are generally horizontally disposed and in serial alignment with each other, with a first bed section being positioned forwardly of the base; a bed folding mechanism that is attached to the base and the bed sections that controls the movement of the bed between the folded and unfolded positions; a foldable leg attached to the first bed section, and a leg folding mechanism attached to the leg and the first bed section configured to extend the leg downwardly from the first bed section when the bed is in the unfolded position, and to fold the leg under the first bed section when the bed is in the folded position, the leg being pivotable about an axis that is parallel with the forward direction.

23 Claims, 10 Drawing Sheets

(56) References Cited

U.S. PATENT DOCUMENTS

| | | | | | |
|---|---|---|---|---|---|
| 2,635,678 | A | | 4/1953 | Basil et al. | |
| 2,654,896 | A | * | 10/1953 | Coopersmith | 5/36 |
| 2,664,145 | A | | 12/1953 | Pennell et al. | |
| 2,696,870 | A | | 12/1954 | Wimende et al. | |
| 2,740,131 | A | | 4/1956 | Vogel et al. | |
| 2,786,213 | A | | 3/1957 | Penneh et al. | |
| 2,804,122 | A | | 8/1957 | Baum et al. | |
| 2,812,227 | A | | 11/1957 | Hill et al. | |
| 2,838,097 | A | | 6/1958 | Gleitsman et al. | |
| 2,876,461 | A | | 3/1959 | Bontempi et al. | |
| 2,877,830 | A | | 3/1959 | Smith et al. | |
| 2,950,753 | A | | 8/1960 | Gleitsman et al. | |
| 2,988,757 | A | | 6/1961 | Pennell et al. | |
| 3,114,574 | A | | 12/1963 | Pryale et al. | |
| 3,121,237 | A | | 2/1964 | Brisdisi et al. | |
| 3,145,049 | A | | 8/1964 | Duke et al. | |
| 3,227,112 | A | | 1/1966 | Wiseman et al. | |
| 3,432,203 | A | | 3/1969 | Cavalli et al. | |
| 3,451,718 | A | | 6/1969 | Kaufman et al. | |
| 3,506,984 | A | * | 4/1970 | Ellis, Jr. et al. | 5/29 |
| 3,908,210 | A | | 9/1975 | Alembik | |
| 3,942,835 | A | | 3/1976 | Harrison | |
| 4,032,999 | A | * | 7/1977 | Pringle | 5/14 |
| 4,045,829 | A | | 9/1977 | Pringle | |
| 4,083,599 | A | | 4/1978 | Gaffney | |
| 4,200,941 | A | | 5/1980 | Gill et al. | |
| 4,557,080 | A | | 12/1985 | Walworth et al. | |
| 4,577,902 | A | | 3/1986 | Crum | |
| 4,669,778 | A | | 6/1987 | Rogers, Jr. | |
| 4,737,996 | A | | 4/1988 | Tiffany | |
| 4,834,449 | A | | 5/1989 | Engelman | |
| 4,946,222 | A | | 8/1990 | Matson | |
| 5,087,094 | A | | 2/1992 | Rogers, Jr. | |
| 5,160,183 | A | | 11/1992 | Rusyniak | |
| 5,186,518 | A | | 2/1993 | Pine | |
| 5,195,194 | A | | 3/1993 | Bradley et al. | |
| 6,904,628 | B2 | | 6/2005 | Murphy et al. | |
| 7,547,182 | B2 | | 6/2009 | Hogue et al. | |
| 8,201,290 | B1 | * | 6/2012 | Hooley et al. | 5/35 |
| 8,438,676 | B2 | | 5/2013 | Murphy | |
| 8,739,330 | B2 | * | 6/2014 | Smith et al. | 5/17 |
| 2007/0283491 | A1 | | 12/2007 | Murphy | |
| 2009/0235452 | A1 | | 9/2009 | Hoffman et al. | |
| 2011/0010846 | A1 | | 1/2011 | Murphy | |
| 2011/0010847 | A1 | | 1/2011 | Murphy | |

* cited by examiner

SEATING UNIT CONVERTIBLE TO BED

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to form a flat, mattress-like sleeping surface. One example is shown in U.S. Pat. No. 2,740,131 to Vogel et al.; others are shown in U.S. Pat. No. 5,195,194 to Bradley, U.S. Patent Publication No. 2007/0283491 to Murphy, and U.S. Patent Publication No. 2011/0010847 to Murphy, the disclosure of each of which is hereby incorporated herein in its entirety. The bed shown in the latter of the Murphy publications includes three separate sections that serve as the mattress of the bed: a seat section; an intermediate section; and a head section. A folding mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing and the seat section serving as the "seat" for the sofa, and an unfolded position, in which the head, intermediate and seat sections are horizontally disposed and serially aligned to form a sleeping surface.

In spite of the existence of these different foldable beds, it may be desirable to offer additional furniture units that can house foldable beds.

SUMMARY OF THE INVENTION

As a first aspect, embodiments of the invention are direction to a seating unit that includes a foldable bed. The seating unit comprises: a base with an internal cavity; a foldable bed that includes a plurality of sections, wherein in a folded position, the bed sections are folded relative to each other and stored within the base cavity, and in an unfolded position, the bed sections are generally horizontally disposed and in serial alignment with each other, with a first bed section being positioned forwardly of the base; a bed folding mechanism that is attached to the base and the bed sections that controls the movement of the bed between the folded and unfolded positions; a foldable leg attached to the first bed section, and a leg folding mechanism attached to the leg and the first bed section, the leg folding mechanism configured to extend the leg downwardly from the first bed section when the bed is in the unfolded position, and to fold the leg under the first bed section when the bed is in the folded position, the leg being pivotable about an axis that is parallel with the forward direction. This configuration can provide a variety of leg styles and can improve seating comfort of the seating unit.

As a second aspect, embodiments of the present invention are directed to seating unit that includes a foldable bed, the seating unit comprising: a base with an internal cavity; a foldable bed that includes a plurality of sections, wherein in a folded position, the bed sections are folded relative to each other and stored within the base cavity, with a seat section serving as the seat for the seating unit, and in an unfolded position, the bed sections are generally horizontally disposed and in serial alignment with each other, with the seat section being positioned forwardly of the base; and a bed folding mechanism that is attached to the base and the bed sections that controls the movement of the bed between the folded and unfolded positions. The seat section includes a plurality of cushions and a plurality of corresponding subframes underlying the cushions, wherein each subframe includes a central opening beneath its corresponding cushion. Once again, a seating unit of this configuration can improve seating comfort.

As a third aspect, embodiments of the present invention are directed to a seating unit that includes a foldable bed, the seating unit comprising: a base with an internal cavity; a foldable bed that includes a plurality of sections, wherein in a folded position, the bed sections are folded relative to each other and stored within the base cavity, and in an unfolded position, the bed sections are generally horizontally disposed and in serial alignment with each other, with a first bed section being positioned forwardly of the base; a bed folding mechanism that is attached to the base and the bed sections that controls the movement of the bed between the folded and unfolded positions; two foldable legs, each attached to opposed outer edge portions of the first bed section, and a leg folding mechanism attached to the legs and the first bed section, the leg folding mechanism configured to extend the legs downwardly from the first bed section when the bed is in the unfolded position, and to fold the legs under the first bed section when the bed is in the folded position such that the legs extend inwardly.

DETAILED DESCRIPTION OF EMBODIMENTS OF THE INVENTION

Figure 1:
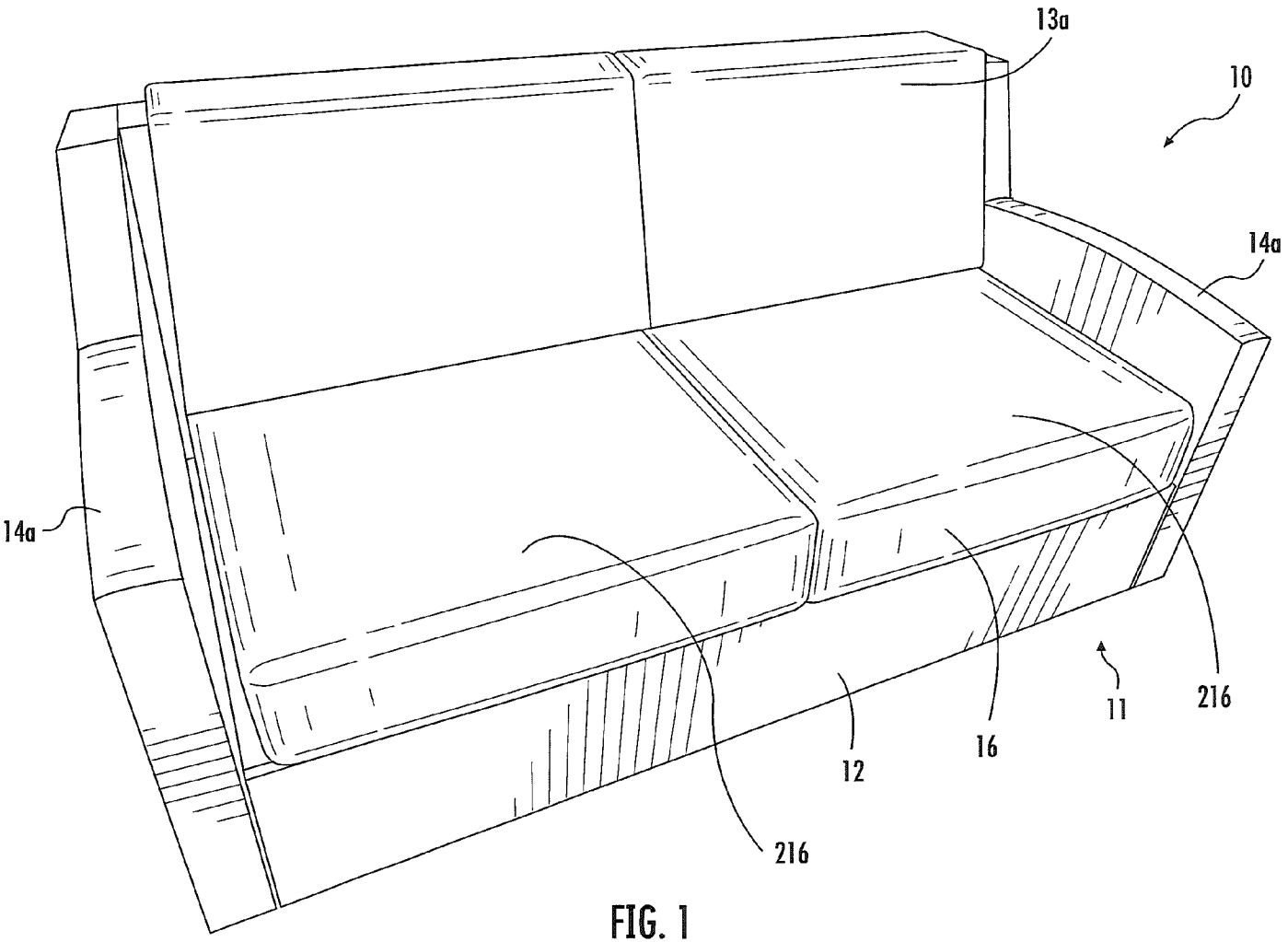
FIG. 1 is a perspective view of a seating unit containing a foldable bed according to embodiments of the present invention, with the bed shown in the folded position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, a seating unit, designated broadly at 10, is illustrated in FIGS. 1-11. The seating unit 10 includes a base 11 having a front wall 12, a rear wall 13 with a backrest 13*a*, and opposed side walls 14 with arms 14*a*; these walls 12, 13 14 define a cavity 17. A foldable bed 15 includes a seat section 16 with an underlying seat frame 18, an intermediate section 20 with an underlying intermediate panel 22, and a head section 24 with an underlying head panel 26. The intermediate and head panels 22, 26 are planar panels, typically formed of wood, that underlie most or all of cushions that provide a comfortable surface for sleeping.

Figure 6:
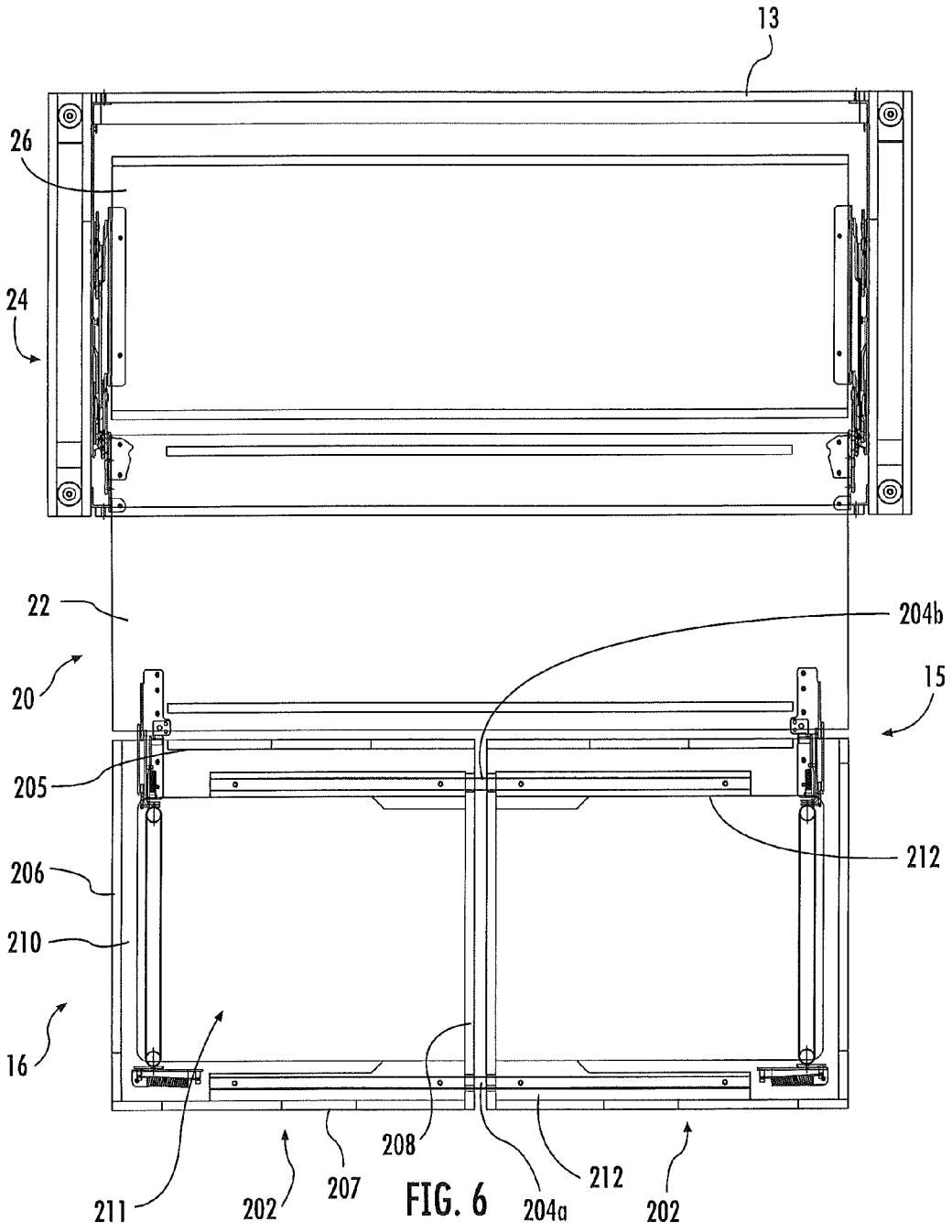
FIG. 6 is a top view of the seating unit of FIG. 2 with the bed shown in its unfolded position and the cushions removed for clarity.
Figure 13:
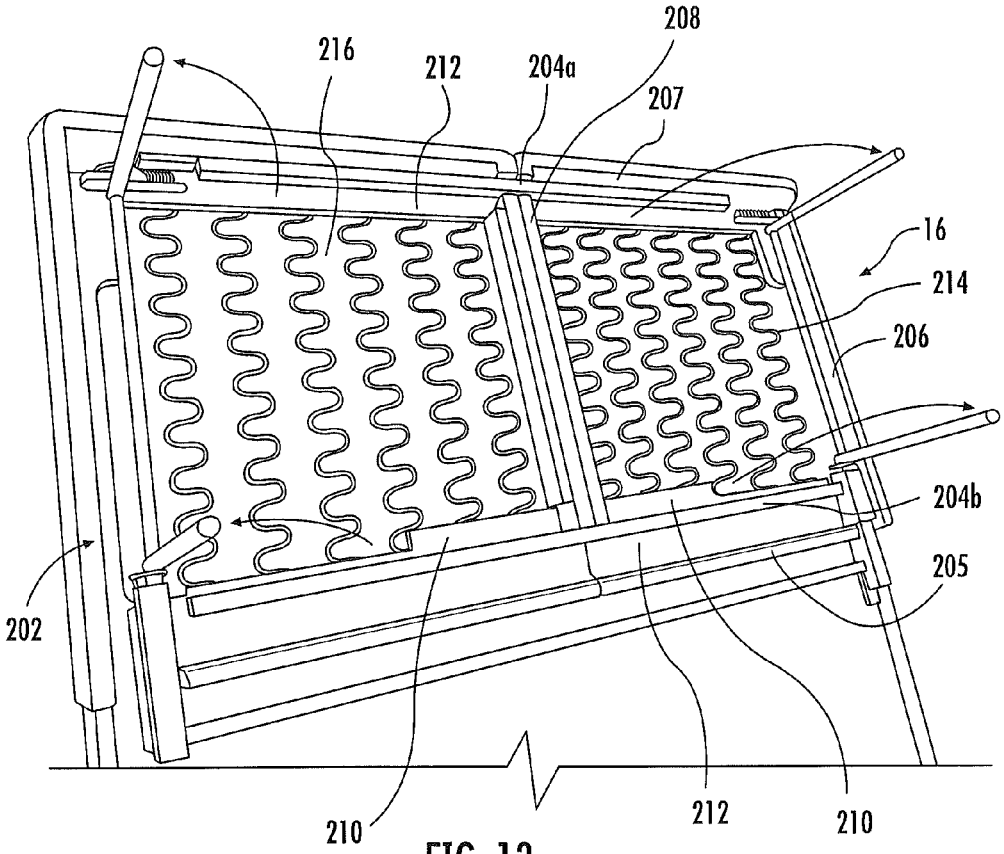
FIG. 13 is a bottom perspective view of the seat section showing the seat frame with its subframes and sinuous springs.

Referring to FIGS. 6 and 13, the seat frame 18 comprises two open square subframes 202 that are attached in side-by-side relationship via cross-members 204*a*, 204*b*. In each subframe 202, vertical panels 205, 206, 207 extend downwardly from the edges of a U-shaped main panel 210, and a vertical panel 208 spans the open end of the main panel 210 to form a generally square opening 211. The cross-members 204*a*, 204*b* are mounted to the underside of reinforcing panels 212 that underlie the "legs" of each main panel 210. In some embodiments, the opening 211 measures between about 14 and 26 inches from back to front. Sinuous springs 214 extend between the vertical panels 205, 207 to span the opening 211 of the subframe 202. Cushions 216 are then fixed to the upper side of the main panel, with upholstery applied to the vertical panels 205, 206, 207, 208 and over the cushions 216 to provide an aesthetically pleasing seat cushion assembly.

The bed 15 is movable between a folded position, in which the seat, intermediate and head sections 16, 20, 24 are generally horizontally disposed and positioned in vertically stacked relationship, with the head section 24 below the intermediate section 20 and the seat section 16 above the intermediate section 20, and with the head and intermediate sections 24, 20 being positioned in the cavity 17 of the base 11 (see FIGS. 1, 2 and 5), and an unfolded position, in which the seat, intermediate and head sections 16, 20, 24 are horizontally disposed and serially aligned to form a sleeping surface (see FIGS. 4 and 6).

The movement of the sections 16, 20, 24 of the bed 15 is controlled by a pair of bed folding mechanisms 30 and a pair of leg folding mechanisms 100, which will be described in greater detail below. The bed folding mechanisms 30 are mirror images of each other about a vertical plane P (FIG. 5) that bisects the seating unit 10 normal to the front wall 12; as such, only one bed folding mechanism 30 will be described herein, with the understanding that the description is applicable to the other mechanism also. The leg folding mechanisms 100 are also mirror images of each other, such that only one will be described in detail herein.

For the sake of clarity, the bed 15 will be described initially in the unfolded position of FIGS. 4 and 6; movement to the folded position of FIGS. 1, 2 and 5 will then follow. As used herein to describe the relative positions of components, the terms "lateral", "outward" and derivatives thereof indicate the directions defined by a vector beginning at the vertical plane P that bisects the seating unit 10 normal to the front wall 12 and extending toward either side wall 14. Conversely, the terms "inward", "inboard" and derivatives thereof indicate the direction opposite the "outward" direction. Together, the "inward" and "outward" directions comprise the "transverse" axis of the seating unit 10. The "rear" of the unfolded bed 15 is located at the end of the bed 15 nearest the rear wall 13 and backrest 13*a* of the base 11 (i.e., toward the head section 24), and the "front" of the bed 15 is located at the end nearest the seat section 16. The "front" and "rear" directions comprise the "longitudinal" axis of the bed 15.

In addition, some components of the bed and leg folding mechanisms 30, 100 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 4:
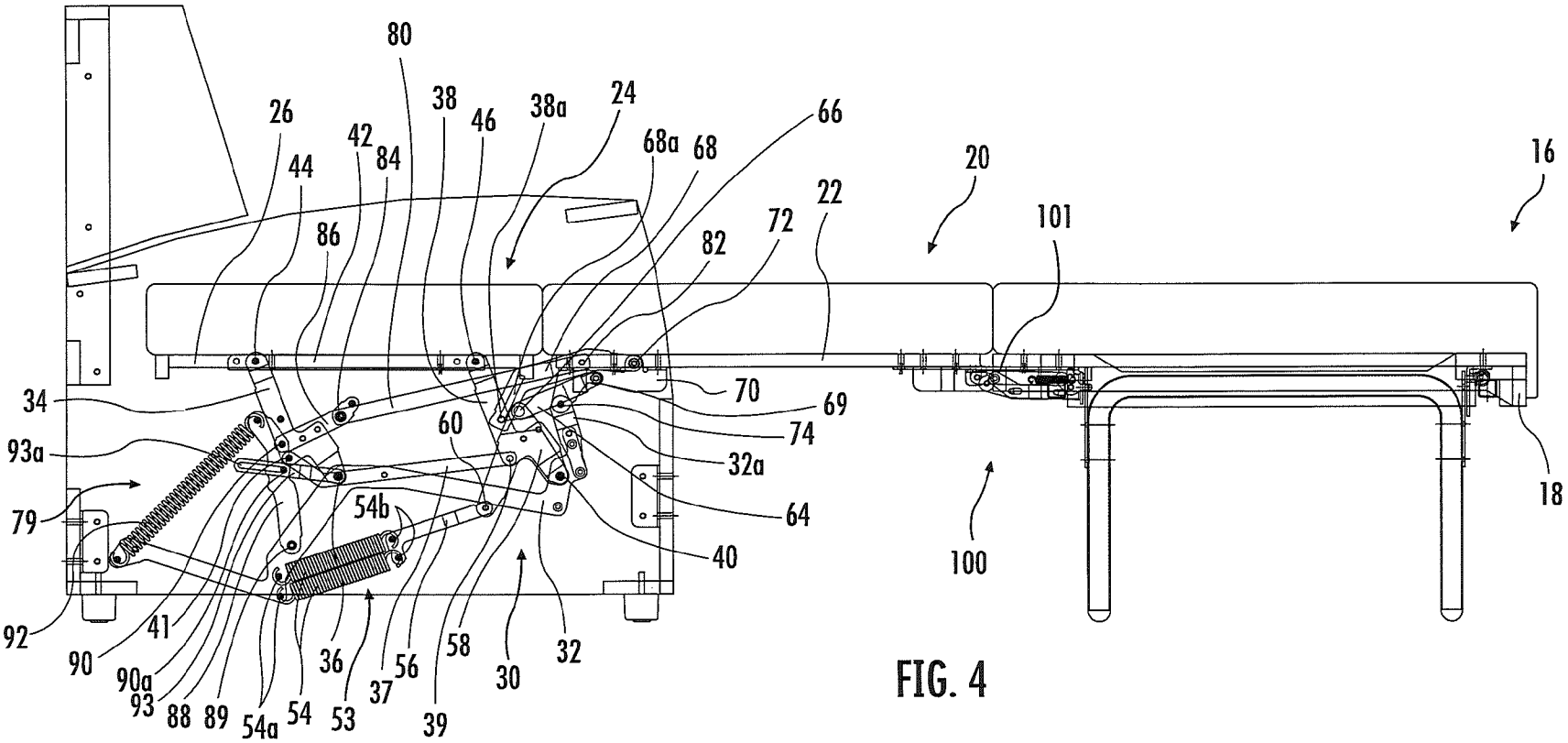
FIG. 4 is a cutaway side view of the seating unit of FIG. 1 with the bed shown in its unfolded position.

Referring now to FIGS. 4 and 6, the bed folding mechanism 30 includes a Z-shaped mounting bracket 32 that is fixed to the inner surface of the side wall 14. An extension 32*a* extends upwardly from the forward leg of the mounting bracket 32. An angled rear swing link 34 is attached to the mounting bracket 32 at a pivot 36 located at the rear vertex thereof and extends upwardly and rearwardly therefrom. A similarly-shaped front swing link 38 is attached to the mounting bracket 32 at a pivot 40 located near the extension 32*a*; the front swing link 38 extends upwardly and rearwardly from the pivot 40. A bent connecting link 37 extends between the front and rear swing links 36, 32 and is attached thereto at pivots 39, 41, respectively. A head section mounting bracket 42 is mounted to the lateral edge of the head panel 26. The rear swing link 34 is attached to the head section mounting bracket 42 at a pivot 44, and the front swing link 38 is attached to the head section mounting bracket 42 at a pivot 46. These links control the movement of the head section 24 between the folded and unfolded positions.

A coupling link 68 is attached to the front swing link 38 via a pin 38*a* on the front swing link 38 that is received in a slot 68*a* in the coupling link 68. In the unfolded position of FIGS. 4 and 6, the pin 38*a* is positioned in the rear end of the slot 68*a*. The coupling link 68 extends upwardly and forwardly from the pin 38*a* to terminate at a pivot 72 with a rear intermediate section mounting bracket 70 fixed to the side of the intermediate panel 22. The rear intermediate section mounting bracket 70 is also attached to the extension 32*a* of the mounting bracket 32 at a pivot 74. These links control the movement of the intermediate section 20 between the folded and unfolded positions and couple the movement of the intermediate section 20 to the head section 24. In addition, the coupling link 68 maintains the head section 24 in position via the interaction between the pin 38*a* of the front swing link 38 and the rear end of the slot 68*a* of the coupling link 68.

Referring once again to FIGS. 4 and 6, the bed folding mechanism 30 has a folding resist unit 53 that includes two springs 54. The springs 54 are mounted at their rear ends to the rear portion of the mounting bracket 32 via pins 54*a*, and are attached at their other ends to a link 56 at pins 54*b*. In the unfolded position of FIGS. 4 and 6, the springs 54 are relatively relaxed. The link 56 is then attached to an angled transition link 58 at a pivot 60. The transition link 58 is pivotally mounted to the mounting bracket 32 at the pivot 40. The upper end of the transition link 58 is attached at a pivot 66 to a stop link 64. The stop link 64 extends forwardly from the pivot 66 to a pivot 69 with the rear intermediate section mounting bracket 70.

The bed folding mechanism 30 also includes a folding assist unit 79. A connecting link 80 extends between pivots 82, 84 with, respectively, the intermediate section mounting bracket 70 and a drawing link 86. A spring link 88 is pivotally attached to the mounting bracket 32 at a pivot 89 and to the drawing link 86 at a pivot 90. A spring 92 (which in the unfolded position is in a stretched or tensioned state) extends between the rear end of the mounting bracket 32 and the upper end of the spring link 88. A control link 93 is attached to the mounting bracket 32 at the pivot 36 and engages a pin 90*a* on the spring link 88 with a slot 93*a*. In the unfolded position of FIG. 4, the pin 88*a* is positioned at the foot end of the slot 93*a*.

Referring now to FIGS. 7-12, the bed 15 includes two generally U-shaped legs 94. The legs 94 are mounted below the seat section 16 and move between a folded position, in which the uprights 95 of the legs 94 extend transversely toward each other and are generally horizontally disposed beneath the seat section 16, and an unfolded position, in which the uprights 95 of the legs 94 are vertically disposed beneath the seat section 16 and rest on an underlying surface to provide support for the seat section 16 from underneath. In the illustrated embodiment, the distance between the uprights 95 of the legs 94 is between about 16 and 24 inches.

Folding of the legs 94 is controlled by the leg folding mechanisms 100 as noted above (only one of which will be described herein). Each leg folding mechanism 100 includes a front intermediate section bracket 102 that is mounted beneath the foot end of the intermediate section 20; the front intermediate section bracket includes a vertical flange 102*a*, on which is mounted a cam 103. A seat section bracket 104 with a side flange 104*a* and an end flange 104*b* is mounted below the seat section 16 such that the brackets 102, 104 are adjacent to each other when the bed 15 is in the unfolded position and are connected at a pivot 105. A gear drive link 106 is mounted to the front intermediate section bracket 102 at a pivot 108 and extends forwardly therefrom. A gear 110 with teeth 112 is mounted to the seat section bracket 104 at a pivot 116 to rotate about a transverse axis. The gear drive link 106 is attached to the gear 110 at a pivot 114. A sprocket 120 with an extension 126 is fixed to one of the uprights 95 of the leg 94 and is attached to the end flange 104*b* of the seat mounting bracket 104 at a pivot 124 that defines a longitudinal pivot axis. The teeth 122 of the sprocket 120 mesh with the teeth 112 of the gear 110. The sprocket 120 also includes a hole 128 slightly offset from the pivot 124. A stop link 130 is mounted to the seat section mounting bracket 104 via two pins 104*c*, 104*d* that are received in slots 130*a*, 130*b*. A post 132 extends inwardly from one end of the stop link 130 in position to interact with the cam 103. A projection 138 extends from the opposite end of the stop link 130 and is aligned with the hole 128 of the sprocket 120. A spring 136 is mounted to the side flange 104*a* of the seat section bracket 104 and to the stop link 130 near the projection 138.

A bracket 150 is mounted to the underside of the foot end of the seat section 16. A vertical panel 151 is fixed to the bracket 150 and includes two quarter-circular slots 150*a*, 150*b*. A tab 150*c* extends inwardly; a post 150*d* is mounted on the tab 150*c*. An extension member 152 is mounted to an upright 95 of the leg 94 and extends upwardly to a pivot 160 with the vertical panel 151. One branch of the extension member 152 extends laterally and includes a pin 152*a* that is received in the slot 150*a*. A shorter branch of the extension member 152 extends inwardly and includes a pin 152*b* that is received in the slot 150*b*. A spring 156 extends between the pin 152*a* and the post 150*d*.

Figure 2:
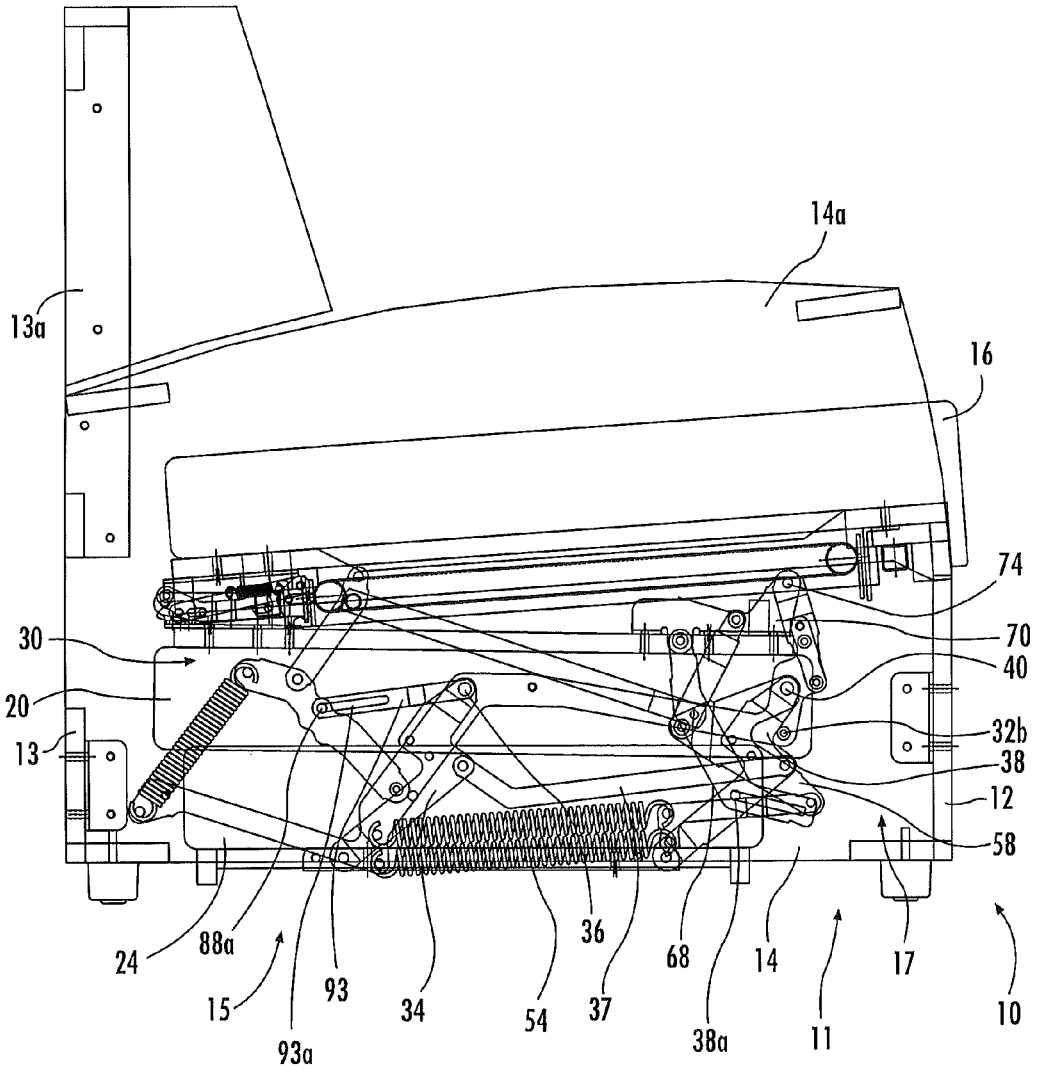
FIG. 2 is a cutaway side view of the seating unit of FIG. 1, with the bed shown in its folded position.
Figure 5:
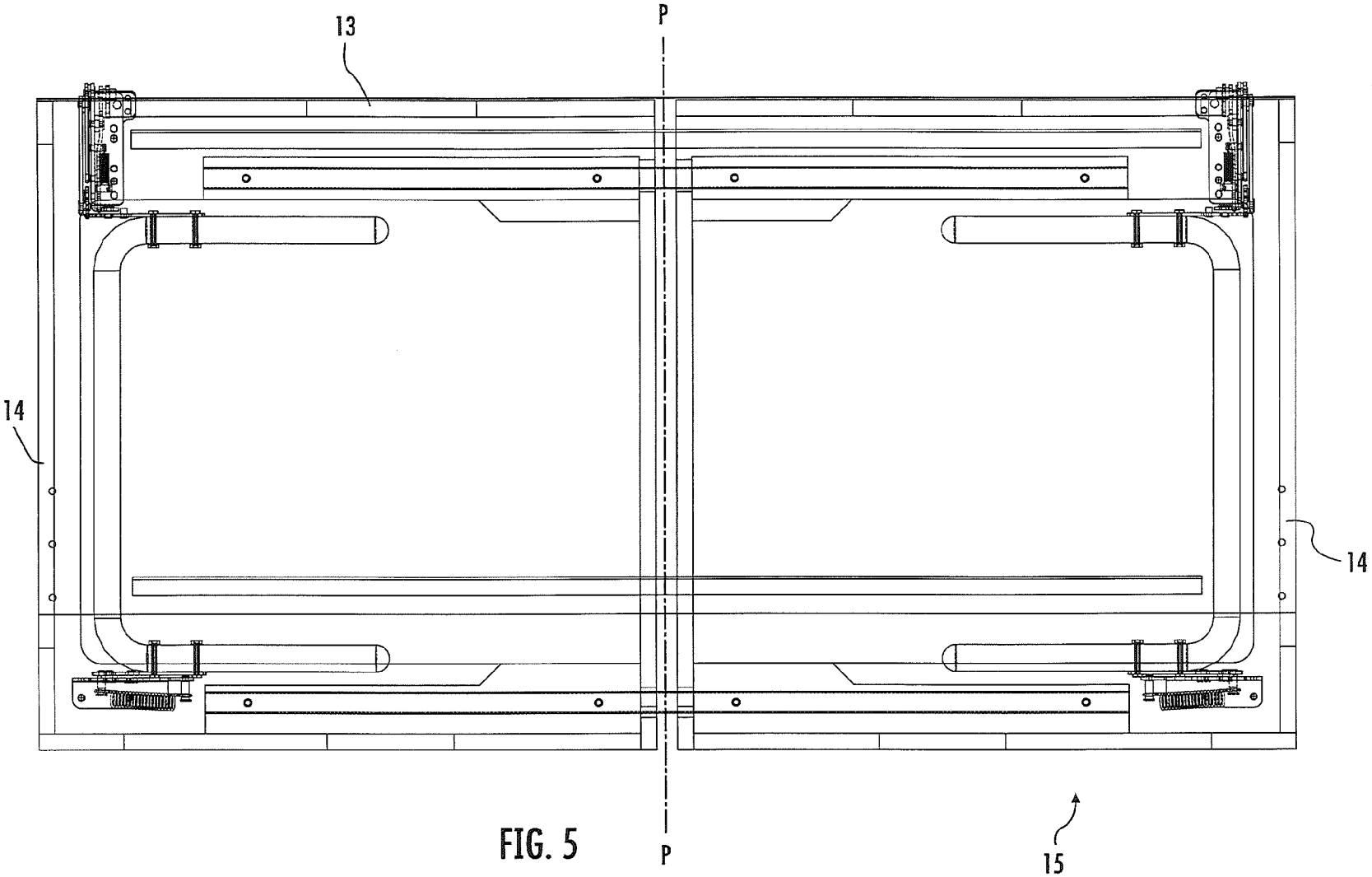
FIG. 5 is a top view of the seating unit of FIG. 1 with the bed shown in its folded position and the cushions removed for clarity.

To move the bed 15 from the unfolded position of FIGS. 4 and 6 to the folded position of FIGS. 1, 2 and 5, a user lifts the front end of the seat section 16. This action also lifts the intermediate section 20, which begins to pivot relative to the base 11 (counterclockwise from the vantage point of FIGS. 2-4) about the pivot 74. The rotation of the intermediate section 20 also forces the coupling link 68 and its slot 68*a* rearwardly and downwardly, which allows the head section 24, by virtue of its own weight, to descend as the rear and front swing links 34, 38 pivot counterclockwise about, respectively, the pivots 36, 40. This motion continues until a pin 32*b* on the mounting bracket 32 stops the rotation of the front swing link 38, at which point the head section 24 has reached its lowest position within the cavity 17 (see FIG. 3). The intermediate section 20 continues to rotate counterclockwise about the pivot 74 (with the slot 68*a* of the coupling link 68 sliding relative to the pin 38*a*) until it reaches an inverted disposition above the head section 24 (FIG. 2).

Figure 3:
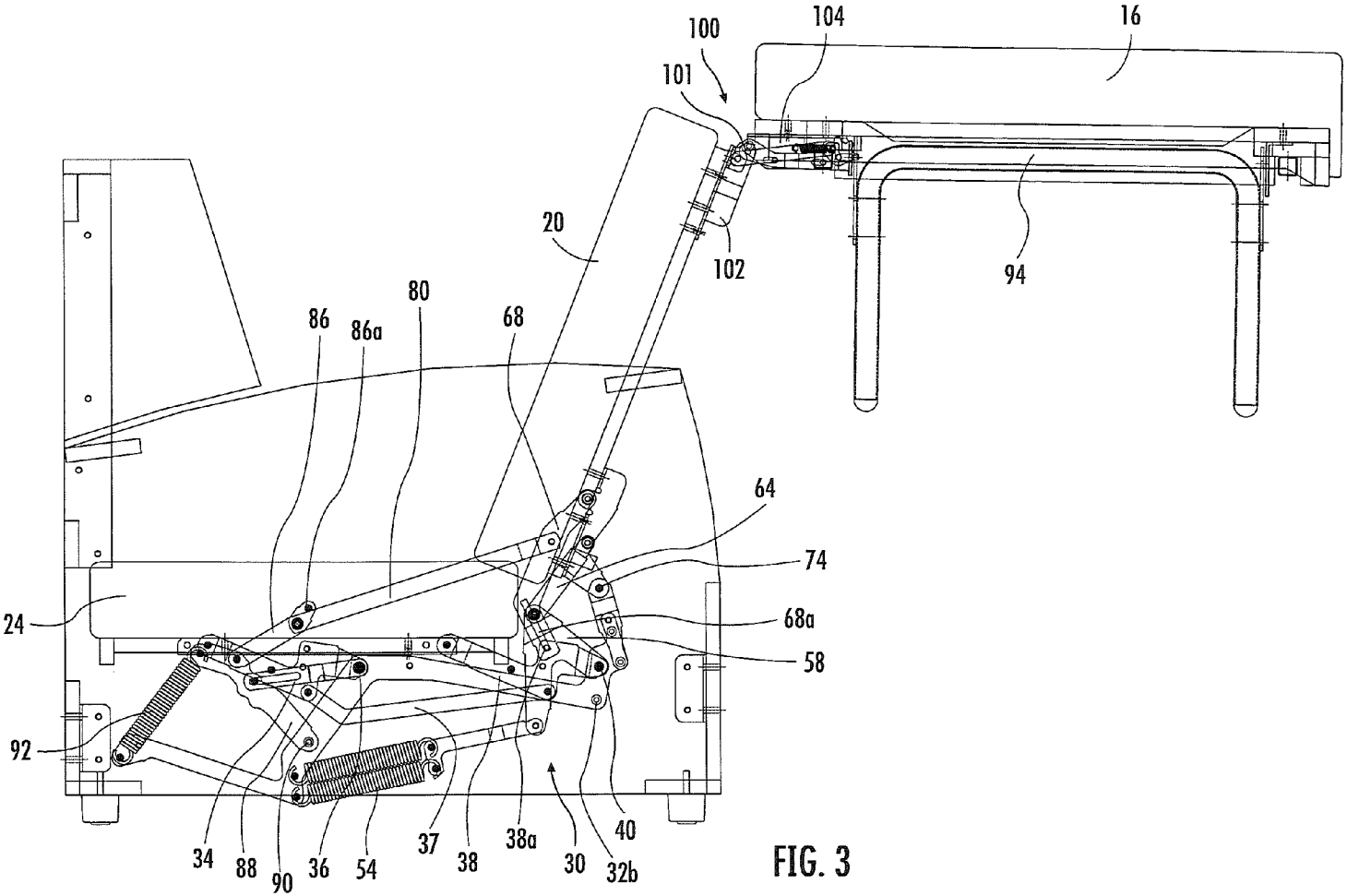
FIG. 3 is a cutaway side view of the ottoman of FIG. 1 with the foldable bed shown in an intermediate position.

It can be envisioned from examination of FIG. 3 that, as the head section 24 descends, it reaches a position in which the pivots 36, 40 are aligned with the pivots 44, 46 (i.e., when the head section 24 is slightly lower than shown in FIG. 3). In this position, in the absence of the connecting link 37 the head section 24 could tend to become unstable and begin to twist or shift rather than continuing to descend in a horizontal disposition. The connecting link 37 can prevent such unwanted twisting.

It can also be seen that, as the seat section 16 rises and the intermediate section 20 begins to rotate about the pivot 74, the connecting link 80 is driven rearwardly. This movement forces the drawing link 86 rearwardly, which causes the spring link 88 to rotate about the pivot 90. This action is aided by the contraction of the stretched spring 92. As a result, an operator receives some assistance in folding the bed 15 during this portion of the folding operation. Rotation of the spring link 88 ceases when the pin 88*a* reaches the rear end of the slot 93*a* (FIG. 3).

It can further be seen that as the intermediate section 20 rotates about the pivot 74, the stop link 64 moves rearwardly and forces the transition link 58 to rotate counterclockwise about the pivot 40. Rotation of the transition link 58 begins approximately when the intermediate section 20 reaches the position of FIG. 3. Rotation of the transition link 58 causes the springs 54 to stretch (FIGS. 3 and 4) and thereby resist the rotation of the transition link 58. As a result, as the foldable bed 15 is moved toward the folded position of FIG. 1, the resistance provided by the springs 54 can help to prevent the bed 15 from dropping or slamming into place due to its weight.

Figure 7:
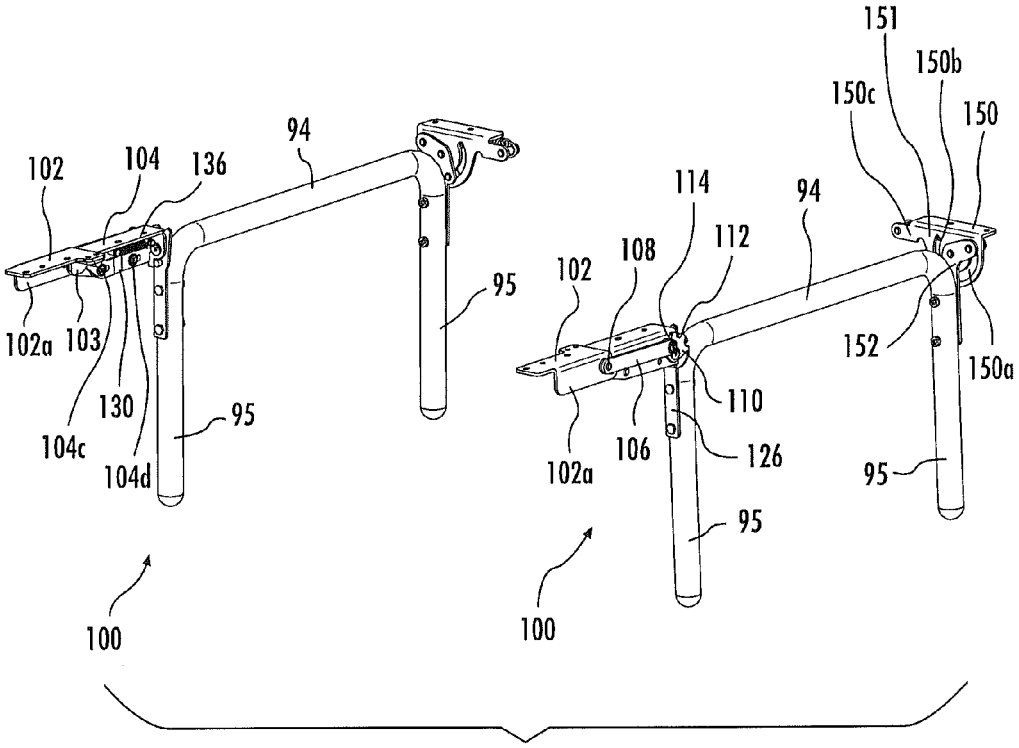
FIG. 7 is a rear perspective view of the leg folding mechanism of the seating unit of FIG. 1, shown in its unfolded position.
Figure 8:
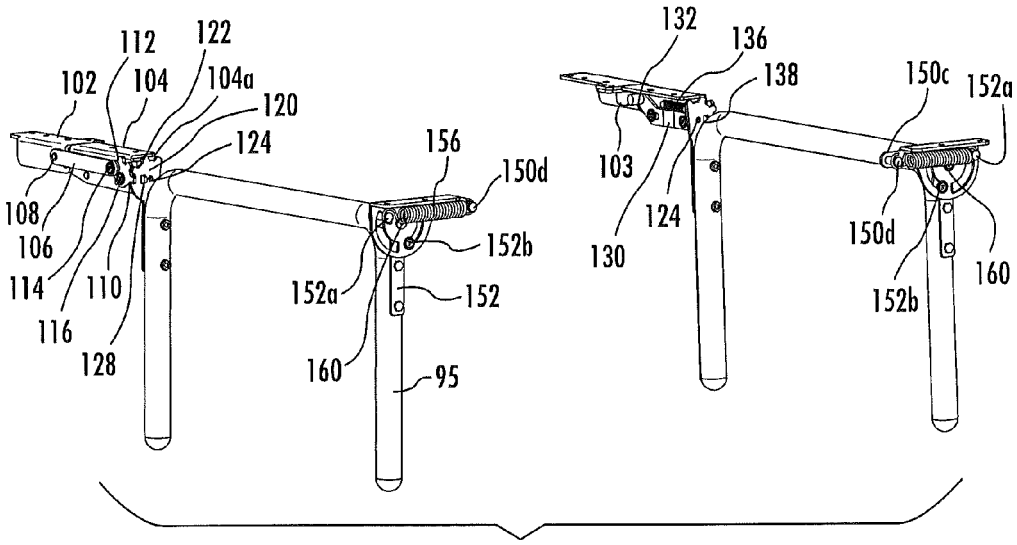
FIG. 8 is a front perspective view of the leg folding mechanism of FIG. 7.
Figure 9:
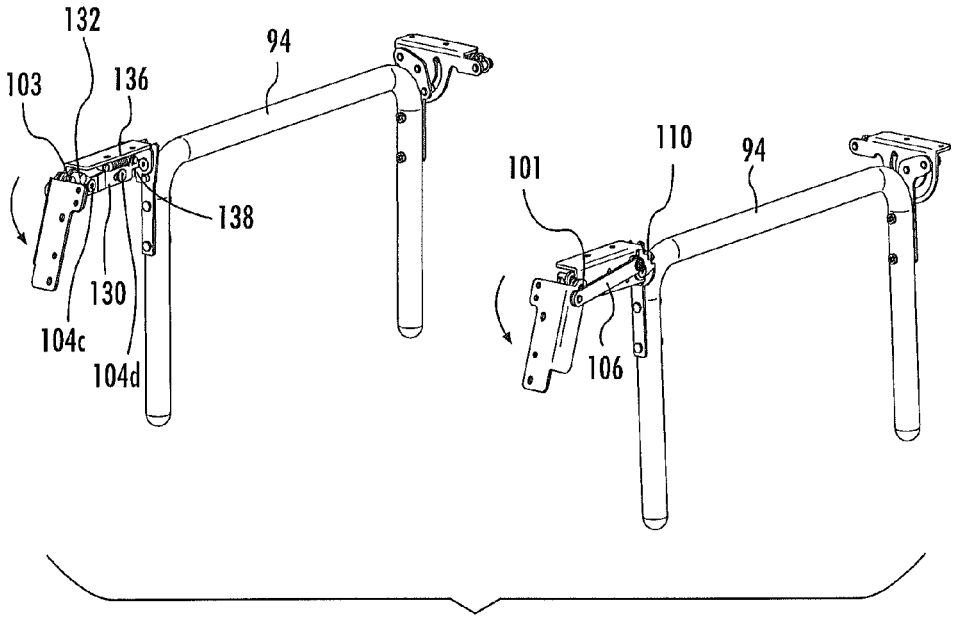
FIG. 9 is a rear perspective view of the leg folding mechanism of FIG. 7, shown in an intermediate position such as in FIG. 3.
Figure 10:
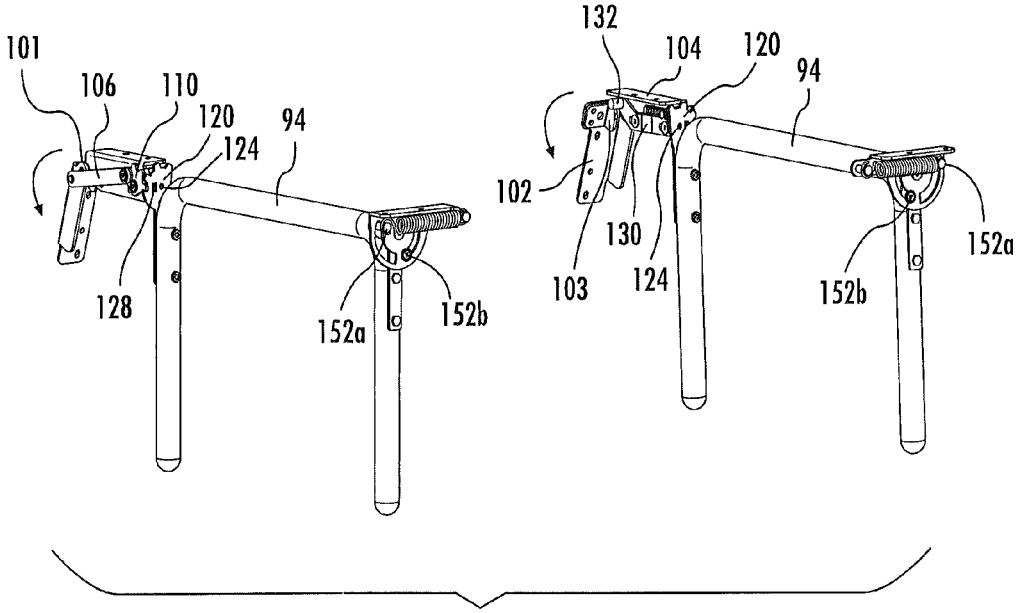
FIG. 10 is a front perspective view of the leg folding mechanism of FIG. 9.

Referring now to FIGS. 7-12, folding of the legs 94 will be described. As can be seen in FIGS. 7 and 8, in the unfolded position, the uprights 95 of the legs 94 extend downwardly away from the seat section 16. The pins 152*a*, 152*b* of the extension 152 are positioned in the lateral ends of the slots 150*a*, 150*b*. The stop link 130 is positioned forwardly (held in that position by the cam 103), such that the pins 104*c*, 104*d* are positioned in the rear ends of the slots 130*a*, 130*b*, which places the spring 136 in tension. The projection 138 is inserted into the hole 128 of the sprocket 120, thereby preventing it from rotating. Such rotation is also prevented by the engagement of the teeth 122 of the sprocket 120 with the teeth 112 of the gear 110.

Figure 11:
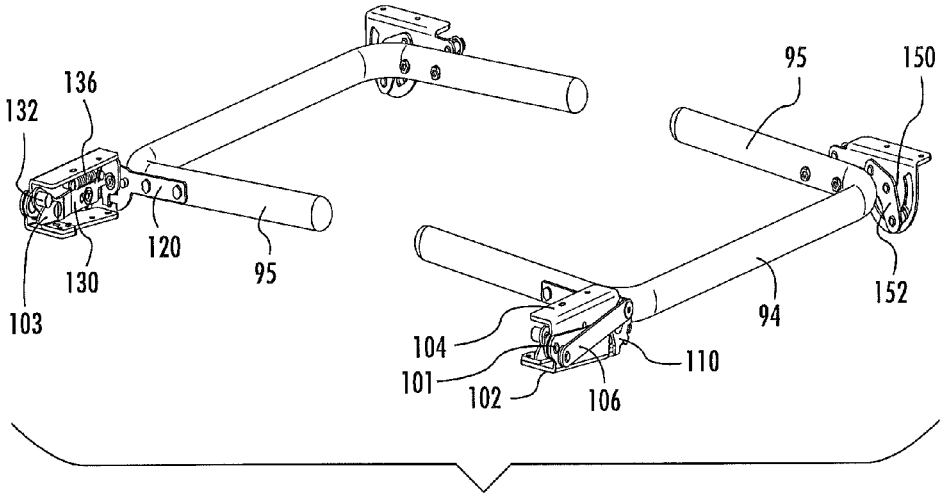
FIG. 11 is a rear perspective view of the leg folding mechanism of FIG. 7, shown in its folded position.
Figure 12:
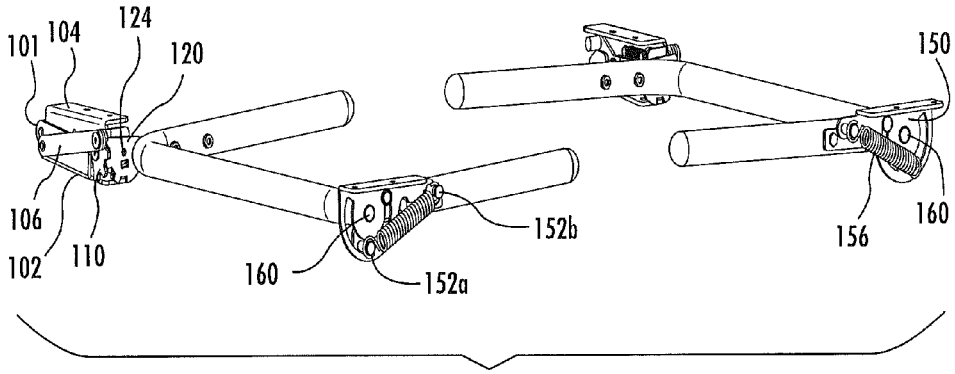
FIG. 12 is a front perspective view of the leg folding mechanism of FIG. 11.

As an operator lifts the seat section 16 to move the bed 15 to the folded position, the relative pivoting of the intermediate section 20 relative to the seat section 16 about the pivot 101 rotates the cam 103 relative to the stop link 130, which enables the spring 136 to contract to draw the stop link 130 rearwardly, thereby removing the projection 138 from the hole 128 in the sprocket 120. After the projection 138 is withdrawn from the hole 128 (FIGS. 9 and 10), the relative rotation of the intermediate section 20 and the seat section 16 draws the gear drive link 106 rearwardly, which action rotates the gear 110 clockwise (from the vantage point of FIGS. 2-4) about the pivot 116. Rotation of the gear 110 rotates the sprocket 120 about the pivot 124 such that the uprights 95 of the leg 94 pivot along a longitudinal axis and extend inwardly to fold underneath the seat section 16 and above the intermediate section 20 (FIGS. 2, 11 and 12). Rotation of the foot end upright 95 also rotates the extension 152 relative to the vertical panel 151 of the foot bracket 150 about the pivot 160, such that the pins 152*a*, 152*b* move inwardly within the slots 150*a*, 150*b* (the pin 152*a* moves downwardly, and the pin 152*b* moves upwardly), which provides stability and smoothness to the movement of the leg 94.

Unfolding of the bed 15 from the folded position of FIG. 1 to the unfolded position of FIGS. 4 and 6 is initiated by lifting the front edge of the seat section 16 and pulling it away from the base 11 of the seating unit 10. The bed folding mechanisms 30 and the leg folding mechanisms 100 reverse the movements described above to enable the bed 15 to unfold, with the legs 94 being fully extended downwardly when the gear drive link 106 is fully forward (approximately the position of FIGS. 3, 9 and 10) and becoming locked in the vertical disposition when the projection 138 enters the hole 128 of the sprocket 120 (FIGS. 4, 11 and 12). Movement ceases when the front swing link 38 rotates sufficiently clockwise about the pivot 40 that a pin 38*a* mounted thereon to strikes the rear edge of the transition link 58 (FIG. 4). The folding resist unit 53 assists in the unfolding operation until the transition link 58 has rotated about the pivot 40 sufficiently that the tension in the springs 54 is substantially absent (approximately the point in the movement shown in FIG. 3). At essentially that point in the movement, the folding assist unit 79 begins to resist the unfolding; the drawing link 86 has rotated sufficiently that a pin 86*a* mounted thereon contacts the upper edge of the connecting link 80 and prevents further relative rotation of these links 80, 86, such that further movement of the intermediate section 20 forwardly rotates the spring link 88 (resisted by the stretching spring 92) about the pivot 90. This biasing of the bed 15 away from the unfolded position can prevent the bed 15 from slamming down into the unfolded position due to its weight.

One of the advantages of the arrangement and movement of the legs 94 can be understood with reference to FIG. 5. In prior foldable beds that fold and unfold similarly (i.e., the seat and head sections maintain their orientation in both the folded and unfolded positions, and the intermediate section is inverted in the unfolded position from its orientation in the folded position), such as that discussed in U.S. Patent Publication No. 2011/0010847 to Murphy, solid panels were included below the cushions of the seat, intermediate and head sections to provide support. While the combination of solid panel and cushion typically provided an acceptable sleeping surface, it often did not provide a comfortable surface for a seated occupant when the bed was in its folded position, as the weight of the seated occupant could "bottom out" the cushion, thereby forcing the occupant to feel the hard surface of the seat panel as support. By including open subframes 202 upon which the cushions of the seat section 16 are mounted, the seat section 16 can provide a seating surface that resembles that of a conventional seating unit. The uprights 95 of the legs 94 are positioned near the vertical panels 205, 207 of the subframes 202, and therefore do not significantly impact the seating comfort provided by the cushions 216 and springs 214.

In addition, a typical seating unit would have sufficient width that multiple people could be seated thereon (e.g., a love seat would have two spots for sitting, a couch would have three spots, etc.). However, prior multi-seat seating units would include only a single wide cushion that covered the entire seat section. This provided an appearance that was undesirable for some consumers. However, the seat section 16 can provide a multi-cushion appearance for multi-seat seating units, which may be more desirable to consumers.

Those skilled in this art will appreciate that seating units according to embodiments of the present invention may take a number of different forms. For example, while legs supporting the seat section in the unfolded position and pivoting about a longitudinal axis may be employed with seating units that fold in the manner described, such legs may also be employed with seating units of different varieties. For example, the seating units described in U.S. Pat. Nos. 2,740,131; 4,200,191; and 4,737,996 and in U.S. Patent Publication Nos. 2007/0283491 and 2011/0010847 may be suitable for use with the present invention. In addition, either or both of the folding assist unit and the folding resist unit may be omitted as desired.

In addition, the mechanism employed to rotate the legs that support the seat section may vary. For example, rather than inducing rotation in the legs via intermeshing gears, the mechanism may employ a series of pivoting links. Also, while the illustrated embodiment is configured such that the legs are essentially fully unfolded by the intermediate position shown in FIGS. 3, 9 and 10, the mechanism may be configured so that the legs unfold either earlier or later in the movement of the bed.

Further, the configuration of the legs themselves may vary. For example, although each of the legs is illustrated as a single generally U-shaped member, it may be configured instead as a U-shaped loop. Alternatively, the seating unit may include four separate leg members, each a straight member, rather than two legs with two upright each. In other embodiments, only two or three uprights may be included rather than four. Other configurations may be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit that includes a foldable bed, the seating unit comprising:

a base with an internal cavity;

a foldable bed that includes a plurality of sections, wherein in a folded position, the bed sections are folded relative to each other and stored within the base cavity, and in an unfolded position, the bed sections are generally horizontally disposed and in serial alignment with each other, with a first bed section being positioned forwardly of the base;

a bed folding mechanism that is attached to the base and the bed sections that controls the movement of the bed between the folded and unfolded positions;

a foldable leg attached to the first bed section, and a leg folding mechanism coupled to the bed folding mechanism attached to the leg and the first bed section, the leg folding mechanism configured to extend the leg downwardly from the first bed section when the bed is in the unfolded position, and to fold the leg under the first bed section when the bed is in the folded position, the leg being pivotable about an axis that is parallel with the forward direction.

2. The seating unit defined in claim 1, wherein the leg includes at least one upright, and wherein in the folded position the upright extends transversely.

3. The seating unit defined in claim 2, wherein the at least one upright is two uprights, each of which extends transversely in the folded position.

4. The seating unit defined in claim 2, wherein the uprights are separated by between about 16 and 24 inches.

5. The seating unit defined in claim 1, wherein the plurality of sections comprises a head section and an intermediate section, and wherein the first bed section is a seat section, and wherein in the folded position the head section is positioned below the intermediate section and the seat section is positioned above the intermediate section, and wherein in the folded position the intermediate section is inverted from its orientation in the unfolded position.

6. The seating unit defined in claim 5, wherein the leg is positioned between the intermediate section and the seat section in the folded position.

7. The seating unit defined in claim 1, wherein the leg folding mechanism comprises a gear driving link configured to move longitudinally when the bed moves between the folded to the unfolded positions, a gear mounted to rotate about a transverse axis, and a sprocket attached to the leg, engaging the gear, and mounted to rotate about a longitudinal axis.

8. The seating unit defined in claim 1, wherein the first bed section includes a cushion and a seat frame having a central open area that underlies the cushion, and wherein in the folded position the leg underlies the main panel.

9. The seating unit defined in claim 1, wherein the bed folding mechanism includes a folding assist unit that biases the bed toward the folded position.

10. The seating unit defined in claim 1, wherein the bed folding mechanism includes a folding resist unit that biases the bed toward the unfolded position.

11. The seating unit defined in claim 1, wherein the leg folding mechanism comprises a gear driving link configured to move longitudinally when the bed moves between the folded to the unfolded positions, a gear mounted to rotate about a transverse axis, and a sprocket attached to the leg, engaging the gear, and mounted to rotate about a longitudinal axis.

12. A seating unit that includes a foldable bed, the seating unit comprising:

a base with an internal cavity;

a foldable bed that includes a plurality of sections, wherein in a folded position, the bed sections are folded relative to each other and stored within the base cavity, with a seat section serving as the seat for the seating unit, and in an unfolded position, the bed sections are generally horizontally disposed and in serial alignment with each other, with the seat section being positioned forwardly of the base; and a bed folding mechanism that is attached to the base and the bed sections that controls the movement of the bed between the folded and unfolded positions;

wherein the seat section includes a plurality of cushions and a plurality of corresponding subframes underlying the cushions, wherein each subframe includes a central opening beneath its corresponding cushion;

the seating unit further comprising:

a foldable leg attached to the seat section, and a leg folding mechanism attached to the leg and the seat section, the leg folding mechanism configured to extend the leg downwardly from the seat section when the bed is in the unfolded position, and to fold the leg under the seat section when the bed is in the folded position, the leg being pivotable about an axis that is parallel with the forward direction.

13. The seating unit defined in claim 12, wherein the plurality of sections further comprises an intermediate section, and wherein in the folded position the seat section is positioned above the intermediate section, and wherein in the folded position the intermediate section is inverted from its orientation in the unfolded position.

14. The seating unit defined in claim 13, wherein the leg is positioned between the intermediate section and the seat section in the folded position.

15. A seating unit that includes a foldable bed, the seating unit comprising:

a base with an internal cavity;

a foldable bed that includes a plurality of sections, wherein in a folded position, the bed sections are folded relative to each other and stored within the base cavity, and in an unfolded position, the bed sections are generally horizontally disposed and in serial alignment with each other, with a first bed section being positioned forwardly of the base;

a bed folding mechanism that is attached to the base and the bed sections that controls the movement of the bed between the folded and unfolded positions;

two foldable legs, each attached to opposed outer edge portions of the first bed section, and a leg folding mechanism coupled to the bed folding mechanism attached to the legs and the first bed section, the leg folding mechanism configured to extend the legs downwardly from the first bed section when the bed is in the unfolded position, and to fold the legs under the first bed section when the bed is in the folded position such that the legs extend inwardly.

16. The seating unit defined in claim 15, wherein each leg includes two uprights, each of which extends transversely in the folded position.

17. The seating unit defined in claim 16, wherein the uprights of each leg are separated by between about 16 and 24 inches.

18. The seating unit defined in claim 15, wherein the plurality of sections comprises a head section and an intermediate section, and wherein the first bed section is a seat section, and wherein in the folded position the head section is positioned below the intermediate section and the seat section is positioned above the intermediate section, and wherein in the folded position the intermediate section is inverted from its orientation in the unfolded position.

19. The seating unit defined in claim 18, wherein the legs are positioned between the intermediate section and the seat section in the folded position.

20. The seating unit defined in claim 15, wherein the leg folding mechanism comprises a gear driving link configured to move longitudinally when the bed moves between the folded to the unfolded positions, a gear mounted to rotate about a transverse axis, and a sprocket attached to each leg, engaging the gear, and mounted to rotate about a longitudinal axis.

21. The seating unit defined in claim 15, wherein the first bed section includes a cushion and a seat frame having a central open area that underlies the cushion, and wherein in the folded position the leg underlies the main panel.

22. The seating unit defined in claim 15, wherein the bed folding mechanism includes a folding assist unit that biases the bed toward the folded position.

23. The seating unit defined in claim 15, wherein the bed folding mechanism includes a folding resist unit that biases the bed toward the unfolded position.

* * * * *